US006976674B2

(12) United States Patent
Honegger

(10) Patent No.: US 6,976,674 B2
(45) Date of Patent: Dec. 20, 2005

(54) METHOD OF, AND APPARATUS FOR, CONVEYING SHEET LIKE PRODUCTS

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 168 days.

(21) Appl. No.: 10/316,570

(22) Filed: Dec. 11, 2002

(65) Prior Publication Data

US 2003/0116908 A1 Jun. 26, 2003

(30) Foreign Application Priority Data

Dec. 21, 2001 (CH) ..... 2342/01

(51) Int. Cl.[7] ..... B65H 5/08
(52) U.S. Cl. ..... 271/204; 271/206; 271/82; 198/470.1
(58) Field of Search ..... 271/204, 206, 271/277, 82, 85; 270/52.16; 198/377.03, 198/377.07, 460.03, 462.2, 803.3, 644, 470.1

(56) References Cited

U.S. PATENT DOCUMENTS

| | | | | |
|---|---|---|---|---|
| 4,039,182 A | | 8/1977 | Reist et al. | |
| 4,201,286 A | * | 5/1980 | Meier | 198/461.3 |
| 4,320,894 A | * | 3/1982 | Reist et al. | 271/277 |
| 4,333,559 A | * | 6/1982 | Reist | 198/461.3 |
| 4,566,687 A | * | 1/1986 | Faltin | 271/202 |
| 4,606,173 A | * | 8/1986 | Meier | 53/430 |
| 4,678,172 A | * | 7/1987 | Faltin | 270/18 |
| 4,953,847 A | | 9/1990 | Honegger | |
| 5,244,078 A | * | 9/1993 | Silva et al. | 198/464.3 |
| 5,295,679 A | | 3/1994 | Reist | |
| 5,660,382 A | * | 8/1997 | Meier | 270/52.16 |
| 6,457,708 B2 | * | 10/2002 | Honegger | 271/204 |
| 6,578,843 B2 | * | 6/2003 | Honegger | 271/204 |
| 6,619,651 B2 | * | 9/2003 | Mader | 271/82 |
| 6,736,391 B1 | * | 5/2004 | Reist | 271/205 |
| 2001/0020769 A1 | | 9/2001 | Honegger | |

FOREIGN PATENT DOCUMENTS

| | | |
|---|---|---|
| EP | 0 330 868 | 9/1989 |
| EP | 1 057 762 A1 | 12/2000 |
| FR | 2 420 499 | 3/1979 |

* cited by examiner

*Primary Examiner*—Khoi H. Tran
(74) *Attorney, Agent, or Firm*—Brinks Hofer Gilson & Lione

(57) ABSTRACT

The invention relates to a method of, and an apparatus for, conveying sheet like products (10, 10'), in particular printed products. In each case two or more products (10, 10') are gripped together, in the region of their leading edges (10*a*, 10*a'*), by grippers (3) of a gripper conveyor (1) such that the edges (10*a*, 10*a'*) are alternately spaced apart from one another. In at least one transfer region (4), the products (10, 10') are transferred to at least one removal arrangement (2) such that each product (10, 10') at most partially overlaps the previously transferred product (10, 10'), the leading edges (10*a*, 10*a'*) of the products (10, 10') being spaced apart from one another. The invention has the advantage that the products are directly accessible for further processing.

7 Claims, 5 Drawing Sheets

METHOD OF, AND APPARATUS FOR, CONVEYING SHEET LIKE PRODUCTS

FIELD OF THE INVENTION

The invention relates to a method of conveying sheet like products and to an apparatus for implementing the method.

BACKGROUND OF THE INVENTION

Modern printing machines process printed products with a throughput of approximately 40–60,000 products per hour in so called single production. In the "double production" operating mode, the production rate, on the other hand, is doubled to 80 120,000. The products are received by a conveying arrangement at the outlet of the printing machine and conveyed to a further processing station. The conveying arrangement usually comprises a gripper conveyor with a plurality of grippers moving along a conveying rail. In order for the products not to be adversely affected, it is desirable for them to be conveyed away at a speed which does not exceed a certain maximum speed. Furthermore, the intention is for the products, preferably in both operating modes of the printing machine, to be conveyed away at the same speed, but with, if appropriate, double the conveying capacity. It is known to combine the products into pairs, in the case of which the products are arranged congruently or are offset in relation to one another, and which are received, and conveyed further, by in each case one gripper. The disadvantage here is that, once they have been transferred to a further processing station, e.g. a further conveying arrangement, completely overlapping products have to be separated again, since said products also undergo subsequent processing individually.

SUMMARY OF THE INVENTION

It is an object of the invention to specify a method of conveying sheet like articles, in particular printed products, in the case of which the articles are conveyed with a high throughput and are prepared such that the individual product remains directly accessible. It is a further object of the invention to make a corresponding conveying apparatus available.

According to the invention, in each case two or more products are gripped together, in the region of their leading edges, by grippers of a gripper conveyor such that their edges are alternately spaced apart from one another. The products are conveyed by the grippers and, in at least one transfer region, transferred to at least one removal arrangement. The transfer takes place such that each product at most partially overlaps the products previously transferred to the removal arrangement, the leading edges of the transferred products being spaced apart from one another. The offset position of the products in the gripper is thus advantageously utilized for producing a regular or irregular imbricated formation or an otherwise separated or easily separable product arrangement, which can easily be processed further.

The apparatus according to the invention comprises a gripper conveyor with a plurality of grippers which are capable of gripping in each case two or more products, in an offset position, in the region of their leading edges. It also comprises at least one control arrangement which is capable of opening the grippers in at least one transfer region, as well as at least one removal arrangement by means of which the transferred products are fed to a further processing station. The apparatus can be adapted to the two modes of operation.

In single production, each gripper grips just one product; in double production, it grips two. It is thus possible for the conveying speed to be kept constant while the conveying capacity is doubled.

The transfer in each case of a plurality of products, preferably two products, to the gripper conveyor is carried out, for example, as is described in U.S. Pat. No. 4,953,847. In this case, the products arrive in an imbricated formation on a conveying belt and are gripped in pairs, by individually controllable grippers, at the end of the conveying belt. The grippers have a depth which is greater than the spacing between the leading edges of at least two printed products in the fed imbricated formation. If the spacing between two products in the imbricated formation is greater than the depth of the grippers, then it is possible for in each case two or more products to be pushed together in the imbricated formation by suitable means. One possibility for this purpose, for example, is an auxiliary conveyor which runs along with the conveying belt and has drivers which brake or accelerate the products.

According to the invention, the products are deposited on the removal conveyor such that the individual product remains accessible at at least one edge. In the simplest case the removal arrangement is a belt conveyor on which the products are deposited in the transfer region as the grippers are released at a release location. There is no significant change in the position of the products relative to one another during the transfer, with the result that the products end up located with a corresponding offset on the conveying belt.

In another variant of the invention, the removal arrangement is a gripper conveyor of which the grippers each receive one product. This makes it possible to realize a regular imbricated formation during the removal operation.

In an advantageous development of the invention, there is transfer to two removal arrangements, with the result that two product streams are produced. This advantageously succeeds in reducing the product stream such that the further processing station can process it without the overall throughput of the installation being reduced.

BRIEF DESCRIPTION OF THE DRAWINGS

Examples for configuring the invention are described hereinbelow and illustrated in the drawings, in which, purely schematically.

DESCRIPTION OF THE PREFERRED EMBODIMENTS

Figure 1:
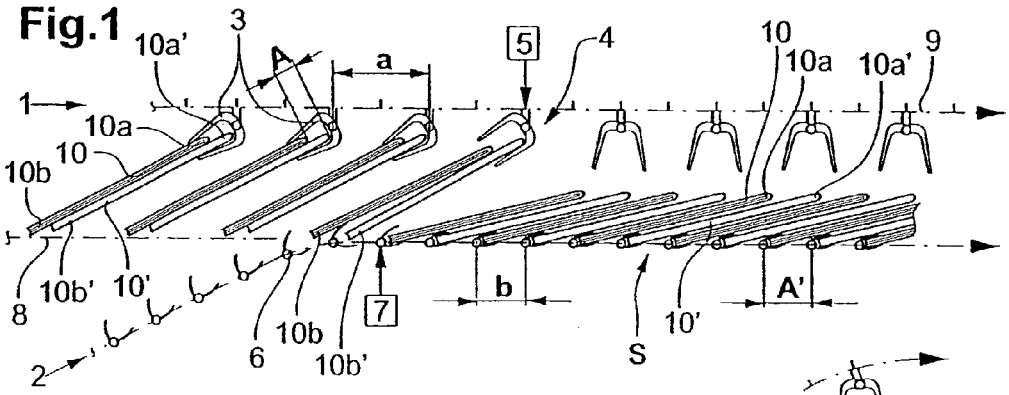
FIG. 1 shows an apparatus in the case of which all of the products are transferred to a removal arrangement in a single transfer region.
Figure 3:
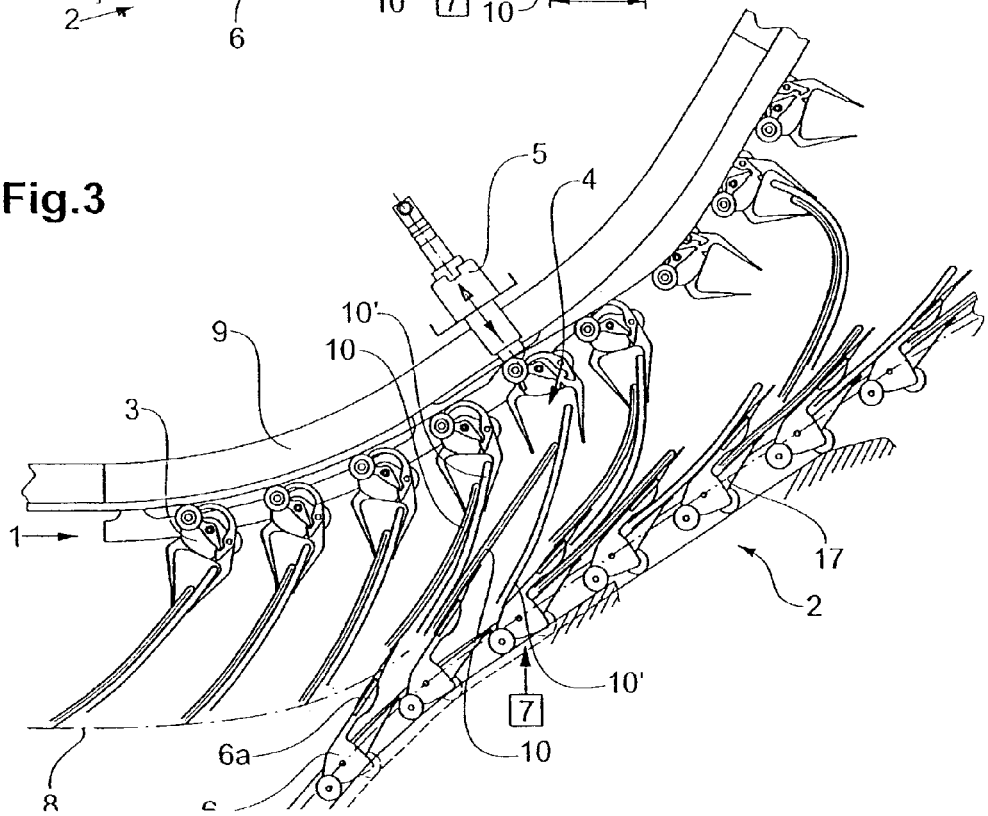

FIG. 1 shows a first apparatus for implementing a method according to the invention. In each case two products 10, 10' are gripped by a gripper 3 and are moved along a guide rail 9 by the corresponding gripper conveyor 1. Within the gripper 3, the leading edges 10*a*, 10*a*' of the products 10, 10' are offset in relation to one another by a spacing A. The trailing edges 10*b*, 10*b*' slide on an underlying surface 8. At least in a transfer region 4, a removal arrangement 2 is located beneath the gripper conveyor 1, said removal arrangement here likewise being a gripper conveyor with a plurality of grippers 6. In the transfer region 4, all the grippers are opened at a release location by a suitable control arrangement 5, which in this case may be a mechanically fixed control guide. The trailing edges 10*b*, 10*b*' of the released products 10, 10' are gripped by in each case one gripper 6 of the removal arrangement 2. Said gripper is closed by a control arrangement 7, which may likewise be a control guide, as soon as the trailing edge 10*b*, 10*b*' is located in the mouth of the gripper 6. Auxiliary means, e.g. a correspondingly configured gripper or a suction arrangement, may be provided, these making it easier for a gripper 6 of the removal arrangement 2 actually to receive just in each case one article 10 or 10'. The operation of sliding into different grippers 6 may, furthermore, be assisted by the gravitational force by the guide rail 9 of the gripper conveyor 1 being inclined out of the horizontal. An example of this is illustrated in FIG. 3. If the products are conveyed horizontally, as is shown in FIG. 1, it is not necessary for the grippers 6 to be closed. Instead of the grippers, it is thus also possible to use U shaped pushing elements.

The spacings a, b between the grippers 3 and 6, respectively, and the conveying speeds of the gripper conveyor 1 and of the removal arrangement 2, respectively, are preferably adapted to one another such that the two conveying arrangements 1, 2 have the same overall conveying capacity. If, as in the present example, the gripper conveyor 1 conveys in each case two products 10, 10' in a gripper 3, the number of grippers 6 of the removal arrangement 2 for each period of time is double the corresponding number of grippers 3 of the gripper conveyor 1. In this case, the spacing a between the grippers 3 of the gripper conveyor is double the spacing b between the grippers 6 of the removal arrangement 2. Following transfer to the removal arrangement 2, the products 10, 10' are present in an imbricated formation S, in the case of which their leading edges 10*a*, 10*a*' are offset in relation to one another by A'. It is also possible, however, for the products to be conveyed further in some other position, as is shown, for example, in FIG. 6.

Instead of the gripper conveyor, it is also possible to use, as removal arrangement 2, a conveying belt on which the products 10, 10' are positioned as the grippers 3 are opened.

Figure 2:
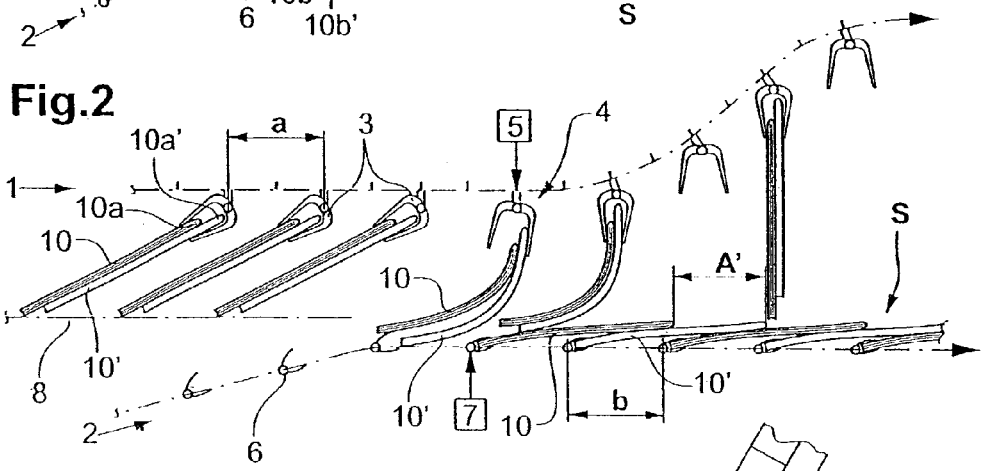
FIGS. 2 and 3 show an apparatus in the case of which, in a transfer region, every second gripper is opened and the products retained by it are transferred to a removal arrangement.

FIG. 2 shows a further apparatus for implementing the method according to the invention. In the region illustrated, the gripper conveyor 1 is essentially identical to the gripper conveyor from FIG. 1. In this case, only every second gripper 3 is opened in the transfer region 4 for transfer to the removal arrangement 2. The rest of the grippers remain closed and transport the products 10, 10' to a further transfer region (not illustrated here). The second removal arrangement provided there may be configured like the removal arrangement 2 shown in FIG. 2. In this case, the removal arrangement 2 has half the conveying capacity of the gripper conveyor 1. The spacings a, b and the conveying speeds are adapted to one another such that, over a period of time, in each case the same number of grippers 3, 6 move past a certain location. In this case, the conveying speeds and the spacings a, b are equal. The products 10, 10' transported away by the removal arrangement 2 are present in an imbricated formation S with an offset A' in relation to one another. The variant shown in FIG. 2 easily succeeds in dividing up the original product stream.

The apparatus shown in FIG. 3 corresponds essentially to the apparatus from FIG. 2. In this case, the guide rail 9 of the gripper conveyor 1 and the guide rail 17 of the removal arrangement 2 are inclined out of the horizontal in the transfer region 4, as a result of which in each case two released products 10, 10' slide into different grippers 6 of the removal arrangement 2. This is assisted in that the grippers 6 have a gripper arm 6*a* which is long enough for two products 10, 10' retained by the same gripper 3 to be raised off from one another by it during the conveying operation. If, then, the gripper 3 of the gripper conveyor 1 is opened by the control arrangement 5 in the transfer region 4, the bottom product 10' slides into the open mouth of the gripper 6, while the top product 10 slides, via the gripper arm 6*a*, into the following gripper 6. The products retained by the grippers 3 which have not been opened are drawn over the already transferred products and may be deposited in a similar manner in a further transfer region, which is not illustrated.

Figure 4:
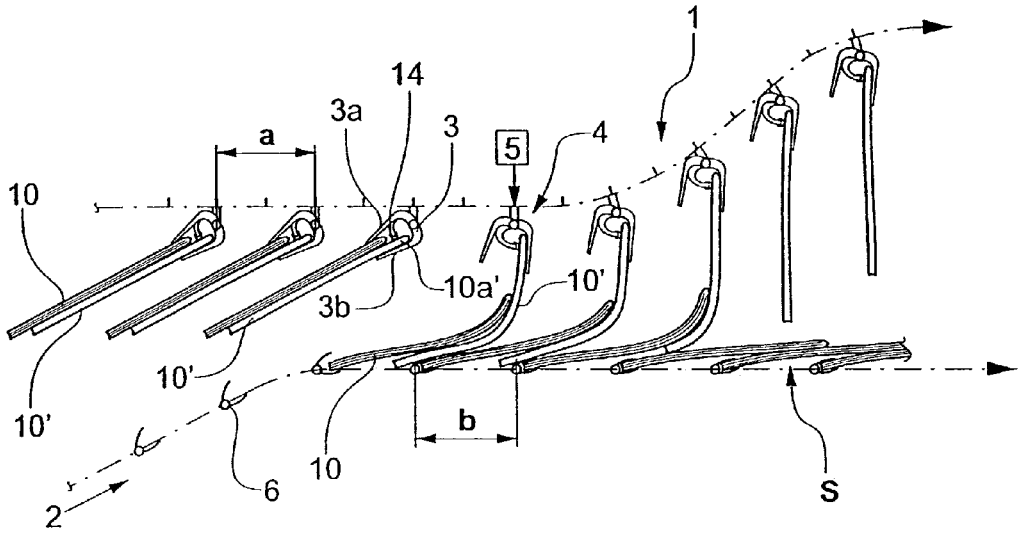
FIG. 4 shows an apparatus in the case of which, in a transfer region, each gripper is opened, but only discharges one of the retained products to a removal arrangement.

FIG. 4 shows a further variant of the method according to the invention and a corresponding apparatus. The grippers 3 of the gripper conveyor 1 in this case are 2 point grippers, which are capable of gripping two articles and releasing them individually. In this case, a gripping arm 14 is provided in addition to the two gripper arms 3*a*, 3*b*, which may be opened and closed in a scissors like manner. While both products 10, 10' are secured in the gripping 3 by the normal gripper arms 3*a*, 3*b*, only the bottom product 10' is fixed by the additional gripping arm 14. The gripper arms 3*a*, 3*b* are moved apart from one another in the transfer region, with the result that the top product 10 is released and slides, over the bottom product 10' retained by the additional gripping arm 14, into a gripper 6 of the removal arrangement 2. The bottom products 10' retained are transported to a further transfer region and, there, are deposited onto a further removal arrangement by virtue of the additional gripping arm 14 being opened. An imbricated formation S of top products 10 is produced on the removal arrangement 2, top and bottom products normally being indistinguishable. What has been said in relation to FIG. 2 applies to the conveying capacities of the gripper conveyor 1 and of the removal arrangement 2. In this case, the conveying speeds and the spacings a, b are equal.

Figure 5:
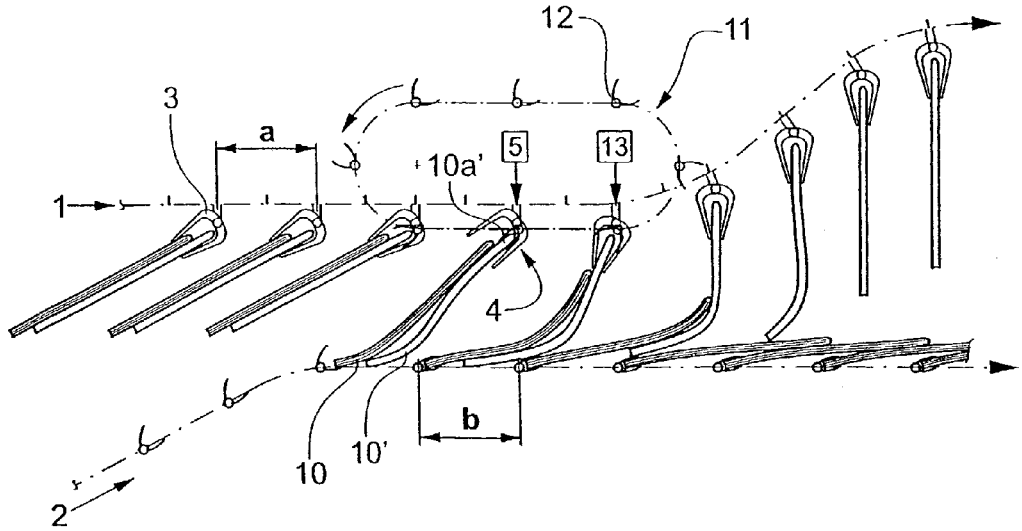
FIG. 5 shows a modification of the apparatus from FIG. 4.

FIG. 5 shows a possible way of implementing the method shown in FIG. 4 without equipping each individual gripper 3 with an additional gripping arm 14. For this purpose, an auxiliary gripper conveyor 11 is provided in addition to the gripper conveyor 1, the grippers 12 of said auxiliary gripper conveyor being moved, in the transfer region 4, parallel to the movement path of the grippers 3 of the gripper conveyor 1. The control arrangement 5 simultaneously opens the main gripper 3 and closes the auxiliary gripper 12, which is moved along synchronously therewith. Alternatively, it is also possible for the auxiliary gripper already to be closed upstream of the transfer region 4. The auxiliary gripper is designed such that it only grips the leading edge 10*a*' of the bottom product 10' and thus retains the latter in the main gripper 3 while the top product 10 slides out. By means of a further control arrangement 13, the main gripper 3 is closed again, once the top product 10 has been discharged, and the auxiliary gripper 12 is opened. As a result, it is only the bottom products 10' which are transported further by the gripper conveyor 1, and these can be deposited on a further removal arrangement in a further transfer region.

In the case of the apparatuses shown in FIGS. 4 and 5, the removal arrangement 2 may be replaced by a belt conveyor if the products are to be transported further essentially horizontally in an imbricated formation S, because in the transfer region 4 in each case just one product is deposited at regular time intervals.

Figure 6:
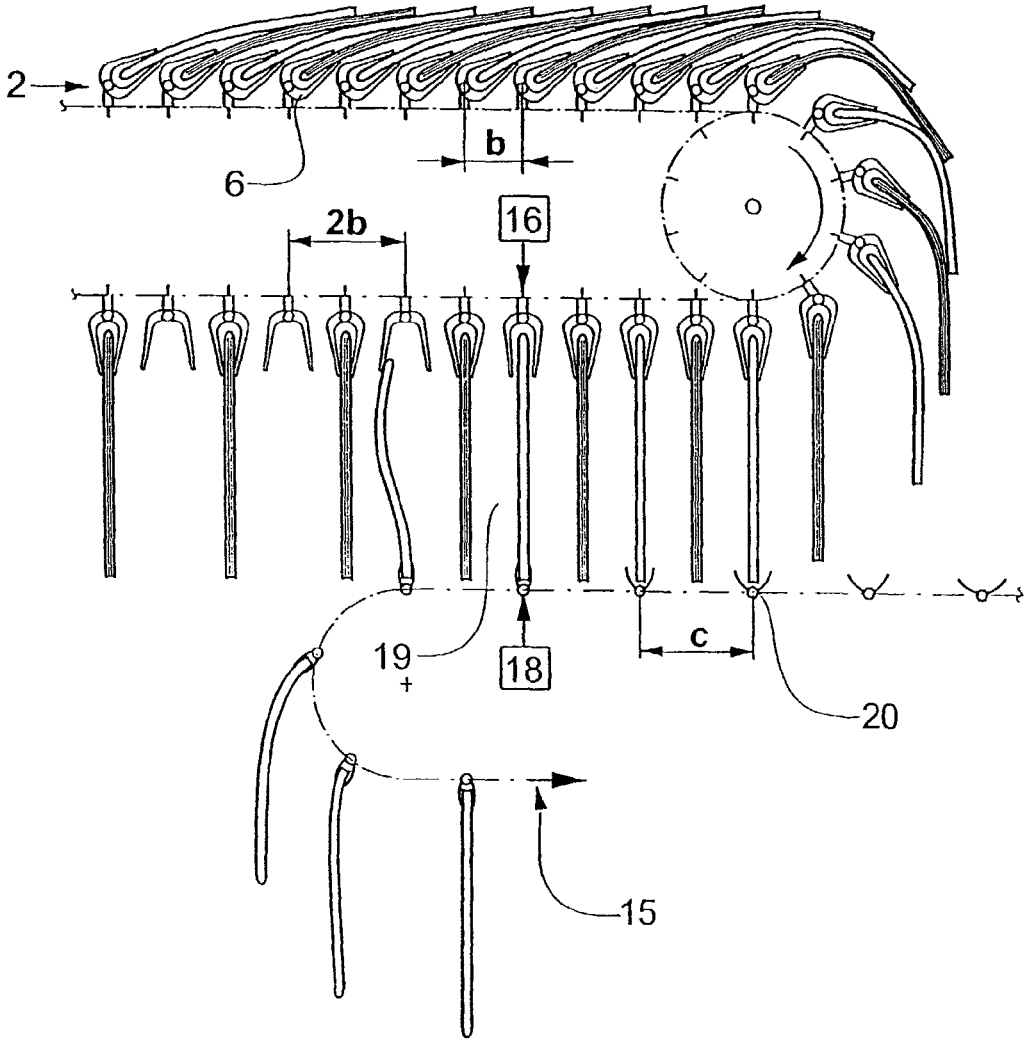
FIGS. 6–8 show possible ways of dividing up into two product streams the product stream which is conveyed away by the removal arrangement from FIG. 1.

FIG. 6 shows a possible way of dividing up into two product streams the product stream which has been transferred to the removal arrangement 2 from FIG. 1. Every second product is transferred, in a further transfer region 19, to a further removal arrangement 15, in this case likewise a gripper conveyor with grippers 20. For this purpose, every second gripper 6 of the removal arrangement 2 is opened by a control arrangement 16, and a gripper 20, which is moved along synchronously therewith and belongs to the further conveying arrangement 15, is closed essentially at the same time by a control arrangement 18. Every second product is thus separated out. In this case, the conveying speeds of the conveying arrangements 2, 15 in the further transfer region 19 are essentially equal. The spacing c between the grippers 20 is double the spacing b between the grippers 6.

Figure 7:
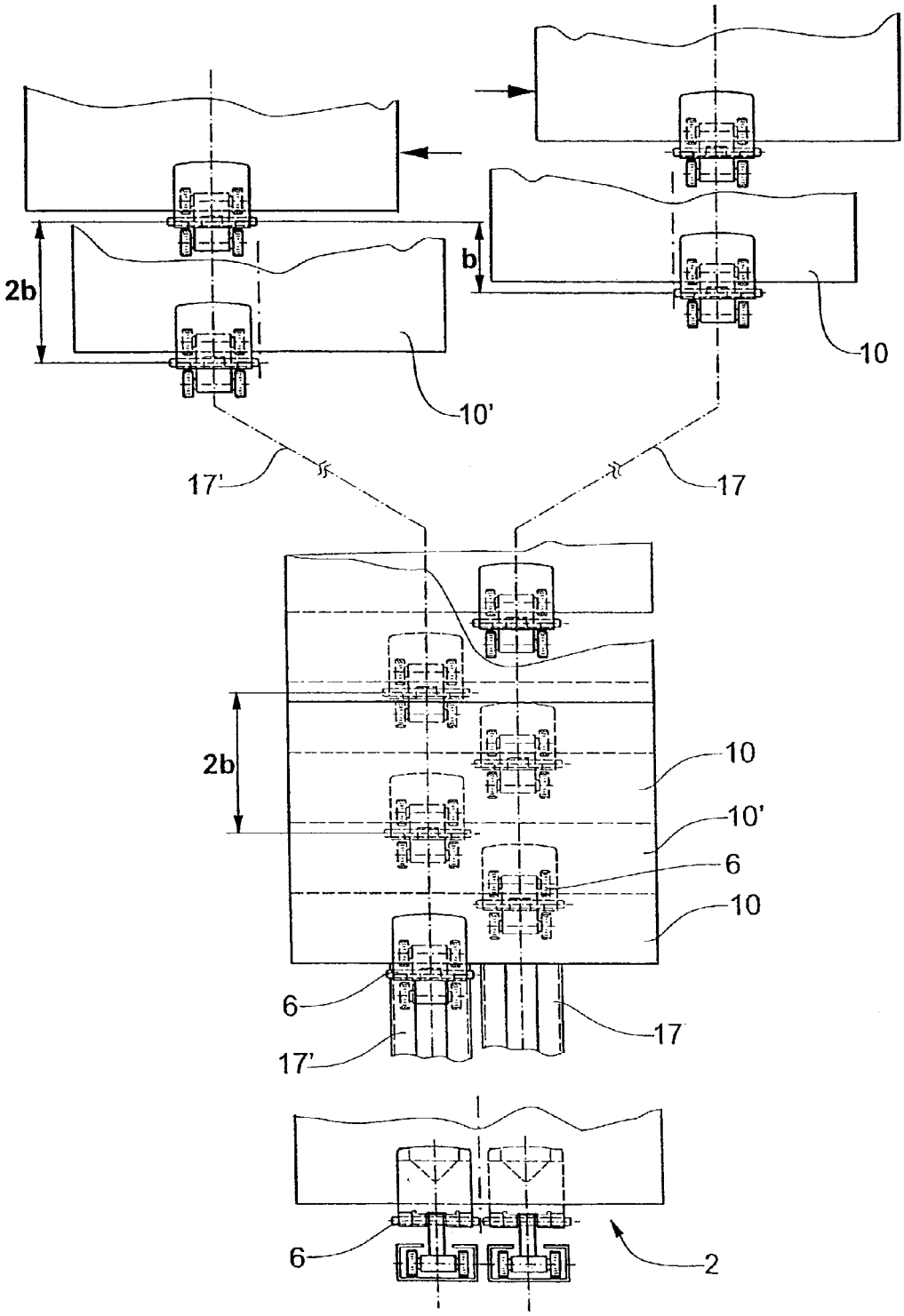
Figure 8:
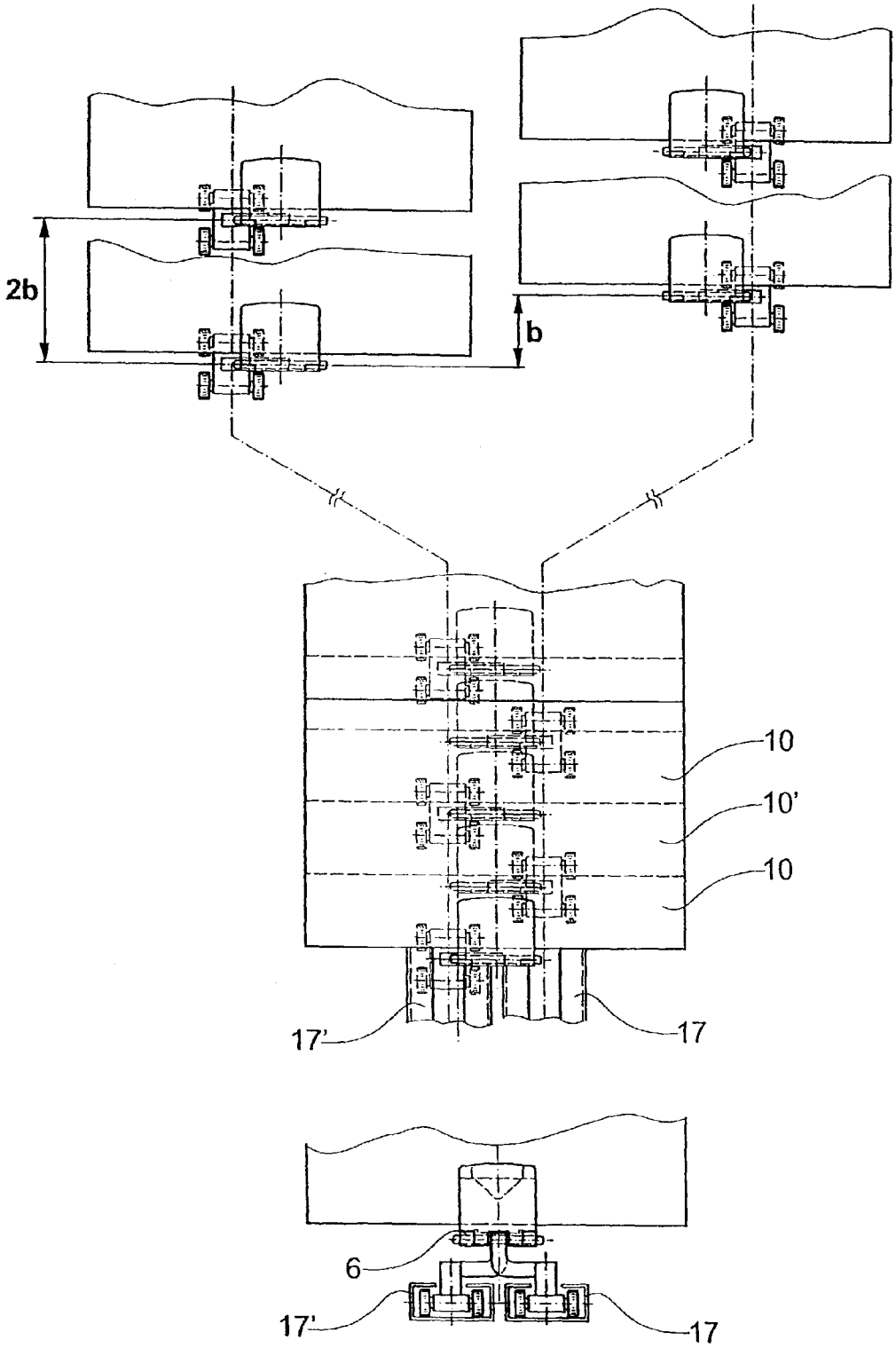

FIGS. 7 and 8 show further examples of dividing up the conveying stream transferred onto the removal arrangement 2, for example according to FIG. 1. The removal arrangements 2 each have a plurality of grippers 6 which are guided in an offset manner in relation to one another along two guide rails 17, 17' which are initially parallel and then diverge. The products 10, 10' are received alternately by grippers of the left hand and right hand guide rail 17, 17', with the result that the conveying stream is drawn apart in a zipper like manner.

What is claimed is:

1. A method of conveying sheet like products, in particular printed products, in each case two or more products being gripped together, in the region of their leading edges, by grippers of a gripper conveyor such that the edges are alternately spaced apart from one another, and the products being conveyed by the grippers, wherein, in at least one transfer region the products are transferred to at least one removal arrangement such that each product at most partially overlaps the previously transferred product, the leading edges of the products being spaced apart from one another, and the at least one removal arrangement is a further gripper conveyor, the spacings between, and the speeds of the grippers of the feeding and removing further gripper conveyors being adapted to one another such that each product to be transferred can be received by a single gripper of the removing further gripper conveyor.

2. The method as claimed in claim 1, wherein one transfer region with one removal arrangement is provided, conveying capacity of the gripper conveyor essentially coinciding with that of the removing further gripper conveyor of the removal arrangement.

3. The method as claimed in claim 1, wherein two transfer regions each with one removal arrangement being a removing further gripper conveyor are provided, every second gripper being opened in the first transfer region and the rest of the grippers being opended in the second transfer region.

4. The method as claimed in claim 1, wherein two transfer regions each with one removal arrangement being a removing further gripper conveyor are provided, each gripper, in the first transfer region, transferring a product to a first removal arrangement and, in the second transfer region, transferring a further product to a second removal arrangement.

5. The method as claimed in claim 4, wherein the gripper conveyor has grippers each with two individually actuable gripper arms, one of the gripper arms being capable of retaining in each case all of the products gripped by the gripper and the other gripper arm being capable of retaining in each case the foremost product arranged in the gripper.

6. The method as claimed in claim 4, wherein auxiliary grippers are moved along with the grippers in the first transfer region and grip in each case the foremost product arranged in the gripper, the gripper being opened in order to discharge the rest of the products when the auxiliary gripper has gripped the foremost product in the gripper, the gripper being closed once the rest of the products have been discharged, and the auxiliary gripper being opened and removed.

7. The method as claimed in one of claims 3 to 6, wherein the conveying capacity of each of the two removal arrangements corresponds essentially to half the conveying capacity of the gripper conveyor.

* * * * *